US005960751A

United States Patent [19]

Isoshima

[11] Patent Number: 5,960,751

[45] Date of Patent: Oct. 5, 1999

[54] INCLINED ENGINE WITH GOVERNOR GEAR

[75] Inventor: Hiroaki Isoshima, Sakai, Japan

[73] Assignee: Kubota Corporation, Osaka, Japan

[21] Appl. No.: 09/054,432

[22] Filed: Apr. 3, 1998

[30] Foreign Application Priority Data

Apr. 4, 1997 [JP] Japan ..... P 9-086195

[51] Int. Cl.[6] ..... F02B 65/00; F02F 1/00

[52] U.S. Cl. ..... 123/58.1; 123/195 C

[58] Field of Search ..... 123/58.1, 195 C, 123/402, 376

[56] References Cited

U.S. PATENT DOCUMENTS 4,135,478 1/1979 Rassey ..... 123/58.1
4,156,409 5/1979 Nakano ..... 123/195 C
4,669,437 6/1987 Shinno ..... 123/376
4,697,557 10/1987 Tamba et al. ..... 123/402

FOREIGN PATENT DOCUMENTS 5-86825 4/1993 Japan .

*Primary Examiner*—Marguerite McMahon
*Attorney, Agent, or Firm*—Bacon & Thomas, PLLC

[57] ABSTRACT

A cylinder body (2) is so formed as to project from a crank chamber (3) in an inclined manner, and a governor gear (50) for driving a centrifugal governor is arranged above a location where a crankshaft (20) is horizontally bridged within the crank chamber (3). An upper wall (71) of the crank chamber (3) is projected upwardly for accommodating the governor gear (50) within the crank chamber (3). An idle gear (45) is arranged at a location above the crankshaft (20) and below the cylinder (46) within the crank chamber (3), and the idle gear (45) is engaged with the crankshaft gear (42) and the governor gear (50) to transmit rotation of the crankshaft gear (42) to the governor gear (50).

6 Claims, 7 Drawing Sheets

INCLINED ENGINE WITH GOVERNOR GEAR

BACKGROUND OF THE INVENTION

1. Field of the Invention

The present invention relates to an inclined engine having its cylinder inclined, and more particularly to an inclined engine having such a construction as to have a governor gear of a centrifugal governor adapted to be rotated by a torque of a crankshaft.

2. Description of the Earlier Technology

Conventionally, there has been proposed such an engine that a valve operating cam gear of a valve operating mechanism and a governor gear of a centrifugal governor are driven by rotation of a crankshaft gear fixedly secured to a crankshaft.

The inventor of the present invention knows an engine provided with a governor gear as shown in FIG. 4.

FIG. 4 is a partial vertical sectional view of a vertical engine disclosed in the Japanese Patent Laid Open Publication No. 5-86825.

This engine 90 has a small diameter crankshaft gear 92 and a large diameter crankshaft gear 93 fixedly secured to a crankshaft 91, a valve operating cam gear 94 engaged with the small diameter crankshaft gear 92 and a balancer gear 95 engaged with the large diameter crankshaft gear 93. By engaging the valve operating cam gear 94 with a governor gear 97 arranged at a lower portion of a crank chamber 96, a torque of the small diameter crankshaft gear 92 is transmitted to the governor gear 97 through the valve operating cam gear 94.

On one hand, conventionally there has been proposed such an inclined engine as to have an axial direction of an engine cylinder inclined with respect to a vertical axis and a horizontal axis for decreasing a total height of the engine or due to restrictions on an engine mounting space. For example, when an engine is inclined by inclining an cylinder 98 of the vertical engine 90 shown in FIG. 4 toward a direction 99 indicated by an arrow, it can be found that a space for arranging the governor gear 97 doesn't exist at a location of a right lower portion of the crank chamber 96. In this case, the governor gear 97 may be arranged within the crank chamber 96 by the following two methods.

A first method has such a construction that, as shown in FIG. 5(A), only a small diameter crankshaft gear 100 is fixedly secured to the crankshaft 91, the valve operating cam gear 94 is engaged with the small diameter crankshaft gear 100, and a large diameter governor gear 102 is engaged with the same small diameter crankshaft gear 100 so as not to interfere with a connecting rod, a counter weight 101 and so on.

A second method has such a construction that, as shown in FIG. 5(B), a small diameter crankshaft gear 106 and a large diameter crankshaft gear 104 are fixedly secured to the crankshaft 91, the valve operating cam gear 94 is engaged with the small diameter crankshaft gear 106, and a governor gear 103 is engaged with the large diameter crankshaft gear 104. Also in this construction, it is necessary to considerably increase a diameter of the large diameter crankshaft gear 104 so that a governor mechanism (not illustrated) fixedly secured to the a governor gear 103 doesn't interfere with a connecting rod, a counter weight 101 and so on.

Conventional examples as mentioned above have the following problems.

First, with the first method as shown in FIG. 5(A), since it is necessary to arrange the large diameter governor gear 102 so as not to interfere with the connecting rod, the counter weight 101 and so on, there appears such a problem that a portion of the crank chamber where the large diameter governor gear 102 is arranged projects out. This is because, when the large diameter governor gear 102 having a radius L which does not interfere with the counter weight 101 and so on is employed therein, the radius L also elongates outwardly from a center of a governor shaft 105 and therefore the crank chamber can't help becoming larger for accommodating the large diameter governor gear 102. Further, since the rotational speed transmitted from the crankshaft 91 to the governor shaft 105 is reduced, there appears another problem that sensitivity of the centrifugal governor becomes worse.

Next, with the second method as shown in FIG. 5(B), since the rotational speed of the governor shaft 105 is increased in comparison with that of the crankshaft 91, the sensitivity of the centrifugal governor becomes better, But there is a problem that a depth of the crank chamber in the lengthwise direction of the crankshaft 91 becomes larger because it should be more increased by a thickness d of the large diameter crankshaft gear 104 in comparison with a construction having only the small diameter crankshaft gear 106 arranged.

In short, in the inclined engine, even though either of the first method and the second method is adopted, there is a problem that the crank chamber of the engine becomes large and thus an advantage of employing the inclined engine for compact arrangement is diminished.

SUMMARY OF THE INVENTION

The present invention has an object to solve the above-mentioned problems and provide an inclined engine which is capable of decreasing a lateral dimension (a width) and a depth (a length) of the engine.

Another object of the present invention is to provide an inclined engine which doesn't decrease sensitivity of a centrifugal governor.

Still another object of the present invention is to provide an inclined engine having its crank chamber down-sized in consideration of its splash lubricating device.

The other additional objects and advantages of the present invention will become apparent from the following detailed description.

In order to accomplish the above-mentioned objects, the present invention has constructed as follows, when explaining it with reference to, for example FIGS. 1(A) and (B) and FIG. 2(A).

An engine 1 has a crank chamber 3 and a cylinder body 2. The crank chamber 3 has a front wall 68, a back wall 26, a left side wall 63, a right side wall 70 and an upper wall 71. A crankshaft 20 is bridged in the fore and rear direction between the front wall 68 and the back wall 26 within the crank chamber 3. A cylinder axis 65 is made incoincident with a horizontal axis 8 and a vertical axis 5 by projecting the cylinder body 2 upward slantingly by from one of the left side wall 63 and the right side wall 70 of the crank chamber 3. In order to arrange a governor gear 50 for driving a centrifugal governor above the location where the crankshaft 20 is bridged within the crank chamber 3 and to accommodate the governor gear 50 within the crank chamber 3, the upper wall 71 is projected upwardly. Within the crank chamber 3, an idle gear 45 is arranged at a location above the crankshaft 20 and below the cylinder 46, and the idle gear 45 is engaged with both the crankshaft gear 42 and the governor gear 50 to transmit rotation of the crankshaft gear 42 to the governor gear 50.

Since the present invention makes the rotation of the crankshaft gear 42 transmit to the governor gear 50 through the idle gear 45, it is unnecessary to arrange a large governor gear as shown in FIG. 5(A). Accordingly, a lateral width of the crank chamber 3 can be decreased. Further, in the above construction, since the employed governor gear 50 has not a large diameter, its rotational speed is not reduced. Besides, it is possible to solve a problem of lowering the sensitivity of the centrifugal governor.

Further, since it is enough if only one small diameter crankshaft gear 42 is fixedly secured to the crankshaft 20, it is possible to shorten a length of the crank chamber 3 in the depth direction in comparison with the construction having two crankshaft gears 106, 104 arranged as shown in FIG. 5(B).

According to the present invention, if required, the valve operating cam gear 32 may be arranged at a location below the crankshaft 20 bridged horizontally within the crank chamber 3 on an inclined side of the cylinder 45 and engaged with the crankshaft gear 42 so that the rotation of the crankshaft gear 42 can be transmitted also to the valve operating cam gear 32.

Further, in the present invention as shown in FIG. 1(B), it is preferable to arrange the idle gear 45 so that a portion of the idle gear 45 overlaps a lower contour 72 of the cylinder 46 within the crank chamber 3. This construction arranges the idle gear 45 at a location near the crankshaft as put aside below the cylinder 46. Therefore, advantageously the lateral width of the crank chamber 3 can be reduced.

DESCRIPTION OF THE PREFERRED EMBODIMENTS (First Embodiment)

The present invention will be explained in detail with reference to the attached drawings.

Figure 1A:
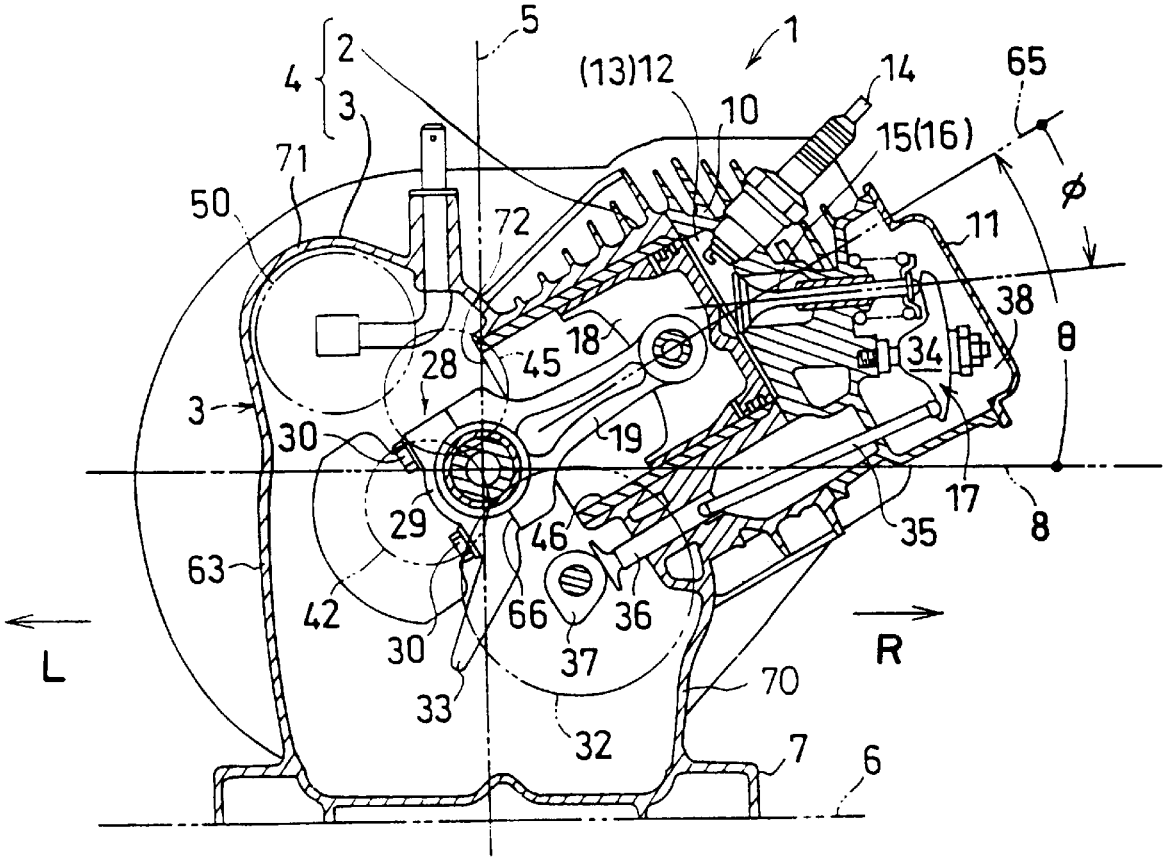
FIG. 1(A) is a schematic front vertical sectional view of an inclined engine according to the present invention.
Figure 1B:
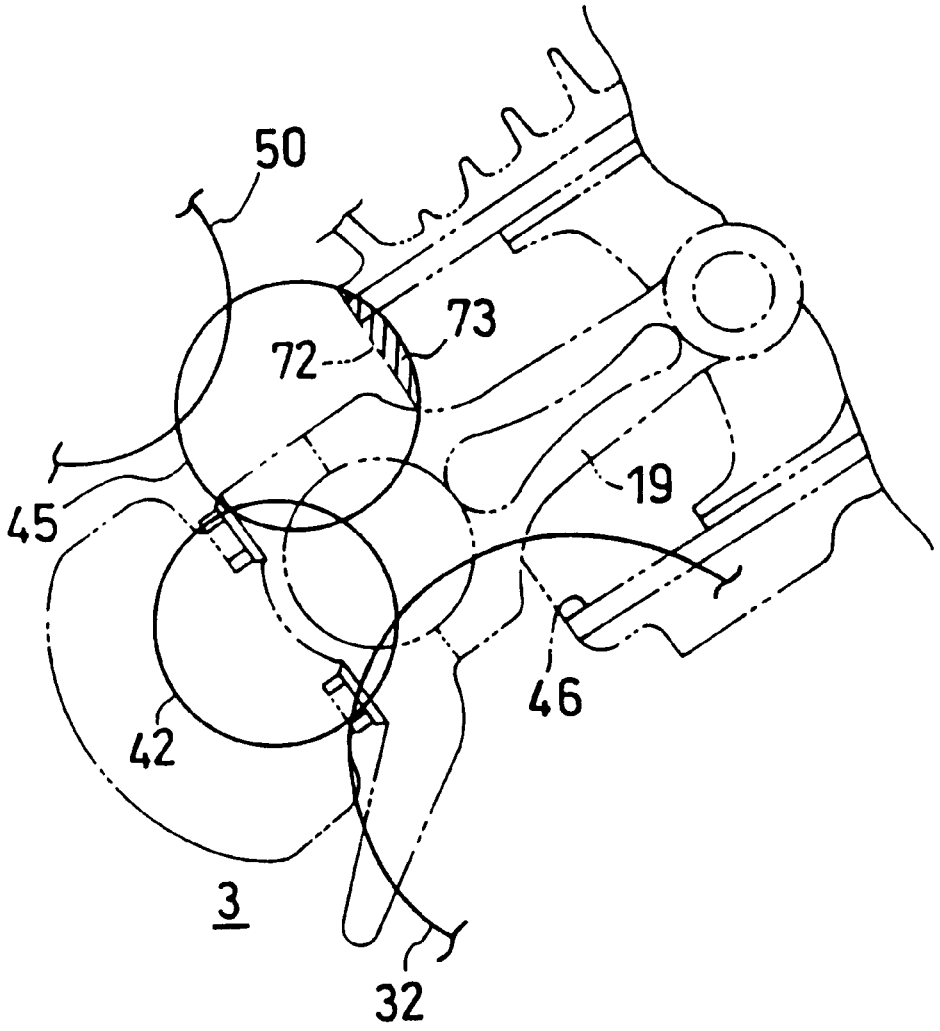
FIG. 1(B) is a schematic enlarged view of a principal portion of the engine shown in FIG. 1(A).
Figure 2A:
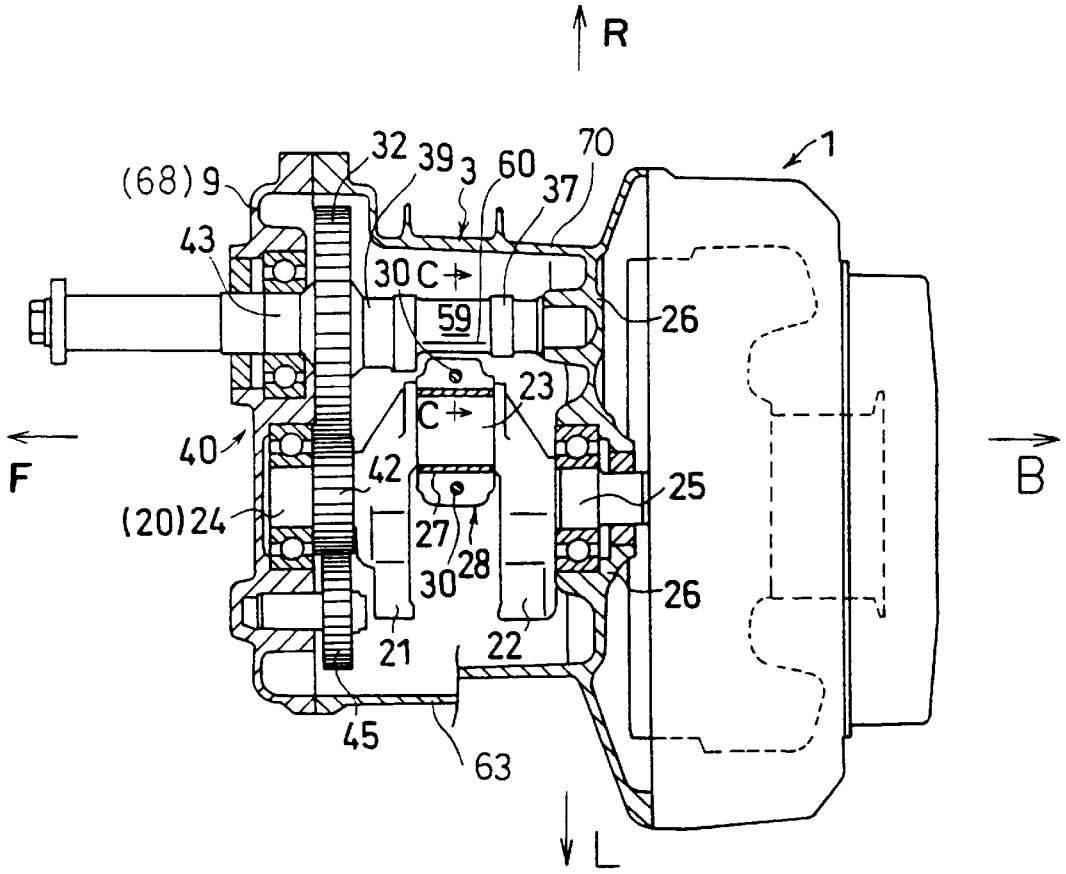
FIG. 2(A) is a schematic horizontal sectional view of the engine, viewed from a bottom wall side of the engine with a crank chamber cross-sectioned by a line connecting centers of a crankshaft gear, an idle gear and a valve operating cam gear.

As shown in FIG. 1, an inclined engine 1 has a crank chamber 3 integrally moulded with a lower portion of a cylinder body 2 to form a cylinder block 4. The crank chamber 3 is formed so as to extend upwardly substantially in parallel to a vertical axis 5, and a foot portion 7 used for mounting the engine 1 onto a foundation 6 is formed at a lower portion of the crank chamber 3 in parallel to a horizontal axis 8. As shown in FIG. 1(A) and FIG. 2(A), the crank chamber 3 has a front wall 68, a back wall 26, a left side wall 63, a right side wall 70 and an upper wall 71, and as shown in FIG. 2(A), a crankshaft 20 is bridged in the fore and rear direction between the front wall 68 and the back wall 26 within the crank chamber 3. The cylinder body 2 projects upward slantingly from the right side wall 70 of the crank chamber 3, and the cylinder body 2 is inclined upward with an angle θ having a range of 30 degrees to 35 degrees with respect to the horizontal axis 8. Incidentally, in FIG. 1(A) and FIG. 2(A), arrows F, B, R, and L indicate a forward side, a backward side, a right side, and a left side, respectively.

As shown in FIG. 1(A), a cylinder head 10 and a head cover 11 are assembled orderly onto the cylinder body 2. A wedge-like combustion chamber 12 substantially triangular in vertical section is formed in a bottom surface of the cylinder head 10 to form a combustion chamber 13 together with a concaved portion formed in a piston head. The combustion chamber 12 has an ignition plug 14, an intake valve 15 and an exhaust valve (not illustrated) arranged. An intake and exhaust valve 16 is adapted to be operated by a valve operating mechanism 17. An inclination angle ϕ of a valve stem of the intake and exhaust valve 16 with respect to a cylinder axis 65 is set to a range of 20 degrees to 30 degrees below this axis 65.

As shown in FIG. 1(A), a piston 18 is fitted into a cylinder 46 of the cylinder body 2 so as to be vertically slidably therein. The piston 18 is interlockingly connected to the crankshaft 20 through a connecting rod 19.

Figure 3:
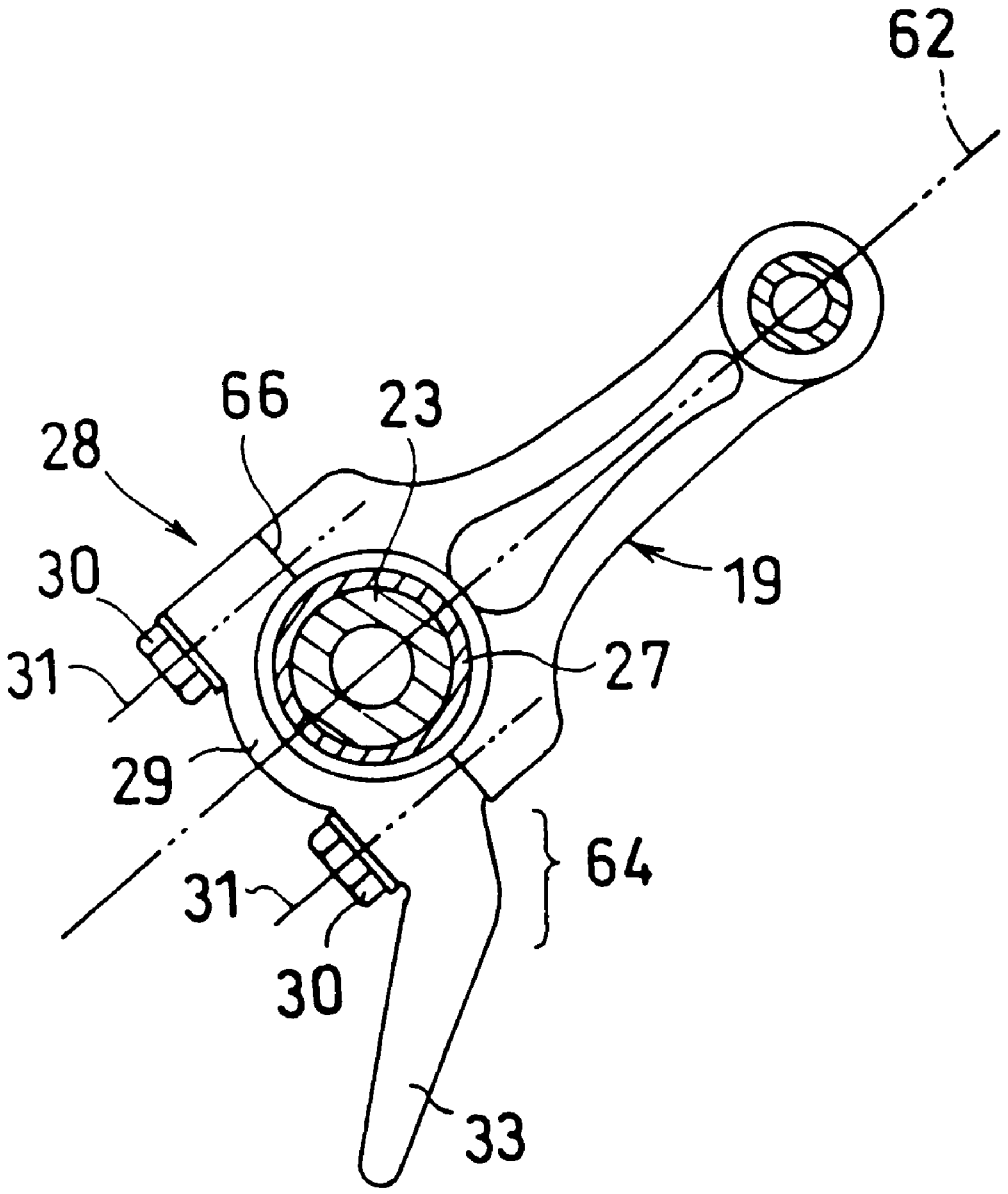
FIG. 3 is an enlarged view of a connecting rod according to the present invention.

As shown in FIG. 2(A), a crank chamber cover 9 serving as the front wall 68 is assembled to the front side of the crank chamber 3. The crankshaft 20 has a crankpin 23 arranged between a pair of fore and rear crank arms 21, 22. Fore and rear crank journals 24, 25 are projected forwardly and rearwardly from the fore and the rear crank arms 21, 22 respectively, and these fore and rear crank journals 24, 25 are supported by the crank chamber cover 9 and the back wall 26 of the crank chamber 3 through bearings respectively, whereby the crankshaft 20 is bridged in the fore and rear direction within the crank chamber 3. As shown in FIG. 3, the crankpin 23 is internally fitted into a big end 28 of the connecting rod 19 through a bearing metal 27. The connecting rod big end 28 is formed by fixing a connecting rod cap 29 to the connecting rod 19 with connecting rod bolts 30. A connecting rod bolt axis 31 of the connecting rod cap 29 is coincident with a longitudinal axial direction 62 of the connecting rod 19.

A dividing line 66 of the connecting rod cap 29 of the connecting rod big end 28 is substantially orthogonal to the longitudinal axial direction 62 of the connecting rod 19. As shown in FIG. 1(A), a downwardly projecting oil splasher 33 is formed integrally with a lateral end portion of the connecting rod big end 28 where the valve operating cam gear 32 exists so as to carry out a splashing lubrication by splashing a lubricating oil stored in a lower portion of the crank chamber 3.

The valve operating mechanism 17 is constructed as follows.

As shown in FIG. 1(A), a rocker arm 34 is arranged at a location near an end portion of the cylinder head 10 on the ground side, and the rocker arm 34 is accommodated within the head cover 11. An output end portion of this rocker arm 34 is kept in contact with a valve stem head portion of the intake valve 15 and an input end portion thereof is kept in contact with a head of a push rod 35. A lower end portion of the push rod 35 is placed on a tappet 36, and a lower end portion of the tappet 36 is placed on a cam surface of a valve operating cam 37.

A lubricating oil within a valve operating chamber 38 is returned to a crank chamber 3 along the rocker arm 34, the push rod 35 and the tappet 36. As shown in FIG. 2(A), a valve operating cam shaft 39 on which the valve operating cam 37 is mounted is supported at its fore and rear end portions by the crank chamber cover 9 and the back wall 26 through bearings respectively so that the valve operating cam shaft 39 is bridged in the fore and rear direction within the crank chamber 3. The valve operating cam shaft 39 is interlockingly driven by the crankshaft 20 through the timing control transmission gear 40.

The timing control transmission gear 40 is constructed as follows.

As shown in FIG. 2(A), a crankshaft gear 42 is fixedly fitted to the fore crank journal 24 of the crankshaft 20. The valve operating cam gear 32 is fixedly fitted to a fore journal 43 of the valve operating cam shaft 39, and the valve operating cam gear 32 is engaged with the crankshaft gear 42. As shown in FIG. 1 (A), the valve operating cam gear 32 is arranged at a right lower location of the crankshaft 20. An idle gear 45 adapted to engage with the crankshaft gear 42 is supported by the crank chamber cover 9 through a bearing at a location above the crankshaft gear 42. And as shown in FIG. 1 (B), the idle gear 45 and a lower contour 72 of the cylinder 46 are displaced from each other at fore and rear positions of the crank chamber 3. In this case, when viewing from the front side of the engine, the lower contour 72 of the cylinder 46 and a portion of the idle gear 45 are arranged so as to overlap each other. In FIG. 1 (B), that overlapping portion is indicated by a hatched portion 73.

A governor gear 50 is arranged in an upper void space of the crank chamber 3 formed by inclining the cylinder axis 65, and the upper wall 71 is upwardly projected so as to accommodate the governor gear 50 therein. Then the idle gear 45 is engaged with the governor gear 50, so that the rotation of the crankshaft gear 42 can be transmitted to the governor gear 50 through the idle gear 45.

Figure 2B:
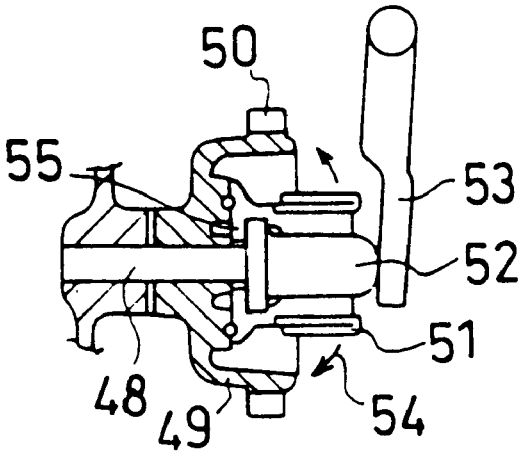
FIG. 2(B) is a schematic sectional view of a centrifugal governor including a governor gear.

FIG. 2(B) is a sectional view showing a centrifugal governor schematically. A bowl-shaped governor case 49 is rotatably supported by a governor shaft 48. Formed on an external peripheral portion of the governor case 49 is the governor gear 50 to engage with the idle gear 45. Flyweights 51 are pivotally supported at their proximal ends by an inner bottom portion of the governor case 49, so that leading end portions of the flyweights 51 can swing outwardly when being rotated. A slide cap 52 is fitted slidably onto the leading end portion of the governor shaft 48, and a leading end portion of a governor lever shaft 53 is kept in contact with a leading end surface of the slide cap 52.

When the rotational speed of the flyweights 51 increases, the leading end portions of the flyweights 51 swing as indicated by arrows 54, and pawls 55 at the proximal end portions of the flyweights 51 rise. Further, the slide cap 52 is slid and the leading end portion of the governor lever shaft 53 is pushed so that an opening degree of a throttle valve of a carburetor can be finely adjusted through a transmission mechanism (not illustrated). The governor gear 50 of the centrifugal governor having the above-mentioned construction is arranged at an upper portion of the crank chamber 3 and engaged with the idle gear 45.

Figure 2C:
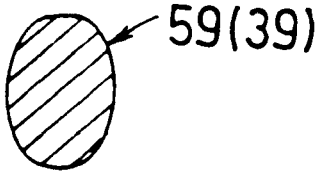
FIG. 2(C) is an enlarged sectional view of an middle portion of a valve operating cam shaft.

As shown in FIG. 2(A) and FIG. 2(C), a middle portion 59 of the valve operating cam shaft 39 to be rotated by the valve operating cam gear 32 has a cross section formed like an elongated circle so as not to interfere with the oil splasher 33 (refer to FIG. 3). Incidentally, a line 60 depicted at a middle portion 59 of the valve operating cam shaft 39 in FIG. 2(A) shows a ridge line of the elongated circle. Since a ratio of a number of revolution of the valve operating cam shaft 39 to that of the crankshaft 20 is set to ½, a flat portion is provided within every 180 degrees of the valve operating cam shaft 39.

Function of the inclined engine having the above-mentioned construction will be explained briefly.

In this inclined engine 1, since a torque is transmitted from the crankshaft gear 42 to the governor gear 50 through the idle gear 45, the diameter of the governor gear 50 can be made substantially equal to that of the crankshaft gear 42, so that the sensitivity of the centrifugal governor can be improved.

Since the division line 66 of the connecting rod cap 29 in the connecting rod big end 28 is substantially orthogonal to the longitudinal axial direction 62 of the connecting rod 19 and the connecting rod bolt axis 31 of the connecting rod cap 29 is coincident with the longitudinal axial direction 62 of the connecting rod 19, when attaching the connecting rod cap 29 by the connecting rod bolts 30, it becomes possible to insert a connecting rod bolt tightening tool diagonally from a lower side through the left side wall 63 of the crank chamber 3 just beside the crankshaft 20 as shown in FIG. 1(A), which makes it unnecessary to project the left side wall 63 of the crank chamber 3 leftwardly. Owing to this construction, the lateral width of the crank chamber 3 can be reduced and it becomes possible to arrange a self starter or the likes at an outside area of the left side wall 63 of the crank chamber 3.

Figure 4:
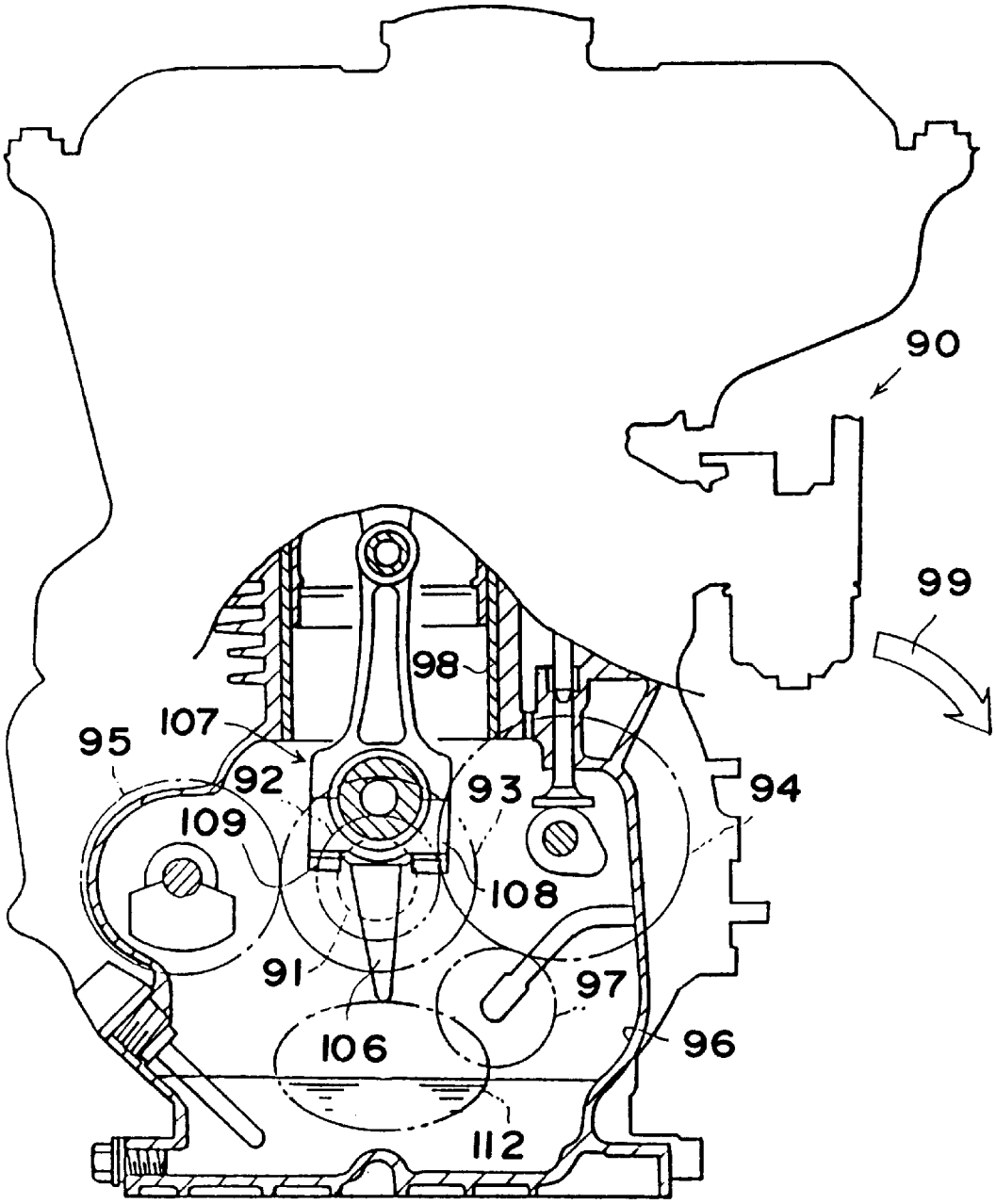
FIG. 4 PRIOR ART
FIG. 4 is a partial vertical sectional view of a vertical engine provided with a conventional governor gear.
Figure 5A:
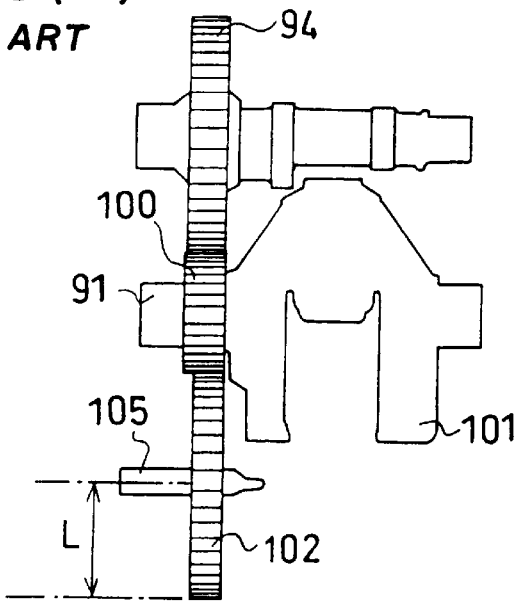
FIG. 5(A) PRIOR ART
FIGS. 5(A), (B) are views showing constructions of timing control transmission gears of conventional engines respectively.
Figure 5B:
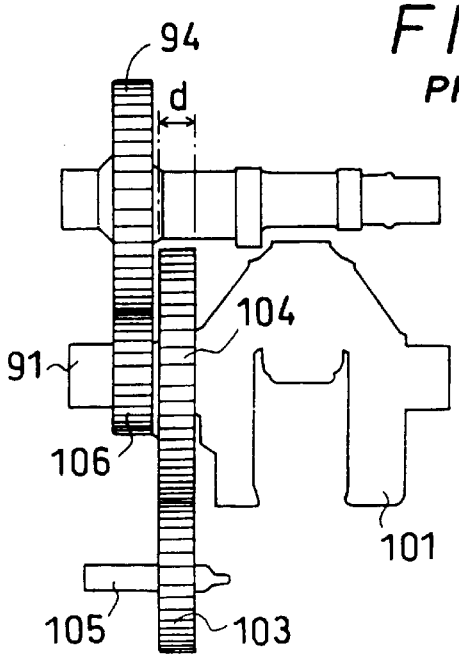
FIG. 5(B) PRIOR ART

Further, since the oil splasher 33 projecting downwardly as shown in FIG. 3 is formed integrally with the lateral end portion of the connecting rod big end 28 where the valve operating cam gear 32 exists even in the inclined engine so inclined as to arrange the valve operating cam gear 32 near to the ground as shown in FIG. 1, it becomes possible to approach a common rotary locus of the oil splasher 106 as shown in FIG. 4 and therefore perform a favorable splashing lubrication.

As shown in FIG. 2, since the middle portion 59 of the valve operating cam shaft 39 has the cross section formed like an elongated circle so that the valve operating cam shaft 39 to be rotated by the valve operating cam gear 32 doesn't interfere with the oil splasher 33, it becomes possible to bring a projecting proximal end portion 64 of the oil splasher 33 illustrated in FIG. 3 closer to the valve operating cam shaft 39 to result in narrowing the lateral width of the crank chamber 3. Owing to this construction, it becomes possible to attach the connecting rod bolts 30 diagonally from the lower side even if the left side wall 63 of the crank chamber 3 illustrated in FIG. 1 is not widened so largely.

This invention is not limited to the above-mentioned embodiment, but various modifications can be made without departing from the spirit and scope of the invention. Such modifications will be explained hereinafter.

(1) Though the foregoing embodiment illustrated in FIG. 1 exemplifies that the idle gear 45 is arranged so that a portion of the idle gear 45 overlaps the lower contour 72 of the cylinder 46, it is not always limited to this construction.

(2) In order to set the inclination angle $\theta$ of the cylinder axis 65 with respect to the horizontal axis 8 to a range of 30 degrees to 35 degrees and the inclination angle $\phi$ of the valve stem of the intake and exhaust valve 16 with respect to the cylinder axis 65 to a range of 20 degrees to 30 degrees, it is preferable to construct the combustion chamber 12 so as to have a wedge-like configuration when considering the arrangement of the valve face. But, the valve operating mechanism according to the present invention is not limited to such a construction as to have the rocker arm 34 illustrated in FIG. 1.

What is claimed is:

1. An inclined engine provided with a governor gear comprising:

an engine (1) including a crank chamber (3) and a cylinder body (2), said crank chamber (3) including a front wall (68), a back wall (26), a left side wall (63), a right side wall (70) and an upper wall (71), a crankshaft (20) bridged in the fore and rear direction between the front wall (68) and the back wall (26) within said crank chamber (3), said cylinder body (2) being projected upward slantingly from one of the left side wall (63) and the right side wall (70) of the crank chamber (3) so that a cylinder axis (65) is made not coincident with a horizontal axis (8) and a vertical axis (5), said upper wall 71 being projected upwardly in order to arrange a governor gear (50) for driving a centrifugal governor above a location where the crankshaft (20) is bridged within the crank chamber (3) and to accommodate the governor gear (50) within the crank chamber (3), and an idle gear (45) arranged at a location above the crankshaft (20) and below the cylinder (46), said idle gear (45) being engaged with both the crankshaft gear (42) and the governor gear (50) to transmit rotation of the crankshaft gear (42) to the governor gear (50).

2. An inclined engine provided with a governor gear as set forth in claim 1, wherein a valve operating cam gear (32) is arranged at a location below the crankshaft (20) bridged horizontally within the crank chamber (3) on an inclined side of the cylinder (45) and adjusted to engage with the crankshaft gear (42) so that the rotation of the crankshaft gear (42) is transmitted also to the valve operating cam gear (32).

3. An inclined engine provided with a governor gear as set forth in claim 1, wherein said idle gear (45) is arranged so that a portion of the idle gear (45) overlaps a lower contour (72) of the cylinder (46) within the crank chamber (3).

4. An inclined engine provided with a governor gear as set forth in claim 2, wherein a combustion chamber of the engine (1) is formed into a wedge-shaped combustion chamber (12), a cylinder head (10) is assembled onto said cylinder body (2), a rocker arm (34) is arranged in said cylinder head (10) on the side near the ground, said rocker arm (34) being swung by the rotation of a valve operating cam (37) driven by the valve operating cam gear (32) through a tappet (36) and a push rod (35) to operate an intake and exhaust valve (16), an inclination angle ($\theta$) of said cylinder axis (65) with respect to the horizontal axis (8) is set to a range of 30 degrees to 35 degrees upwards of the horizontal axis (8) and an inclination angle ($\phi$) of the valve stem of the intake and exhaust valve (16) with respect to the cylinder axis (65) is set to a range of 20 degrees to 30 degrees downwards of the cylinder axis (65).

5. An inclined engine provided with a governor gear as set forth in claim 1, wherein a piston (18) is fitted into said cylinder (46) of said cylinder body (2) so as to be vertically slidably therein, said piston (18) being interlockingly connected to the crankshaft (20) through a connecting rod (19), a connecting rod bolt axis (31) of the connecting rod cap (29) being coincident with a longitudinal axial direction (62) of the connecting rod (19), a dividing line (66) of the connecting rod cap (29) of the connecting rod big end (28) being substantially orthogonal to said longitudinal axial direction (62) of said connecting rod (19), and a downwardly projecting oil splasher (33) being formed integrally with a lateral end portion of the connecting rod big end (28) where the valve operating cam gear (32) exists so as to carry out a splashing lubrication by splashing a lubricating oil stored in a lower portion of the crank chamber (3).

6. An inclined engine provided with a governor gear as set forth in claim 5, wherein a middle portion (59) of the valve operating cam shaft (39) fixedly secured to said valve operating cam gear (32) has a cross section formed like an elongated circle so as not to interfere with said oil splasher (33).

* * * * *